US005345865A

United States Patent [19]

Kemp

[11] Patent Number: 5,345,865

[45] Date of Patent: Sep. 13, 1994

[54] HICKEY REMOVAL SYSTEM

[75] Inventor: Norman H. Kemp, Hurst, Tex.

[73] Assignee: Dahlgren USA, Inc., Carrollton, Tex.

[21] Appl. No.: 172,253

[22] Filed: Dec. 23, 1993

Related U.S. Application Data

[63] Continuation of Ser. No. 44,215, Apr. 7, 1993, abandoned.

[51] Int. Cl.[5] ..... B41F 31/00

[52] U.S. Cl. ..... 101/349; 101/142

[58] Field of Search ..... 101/148, 216, 348, 349, 101/350, 142, 425

[56] References Cited

U.S. PATENT DOCUMENTS

| | | | |
|---|---|---|---|
| 3,467,008 | 9/1969 | Domotor | 101/425 |
| 3,911,815 | 10/1975 | Banfer | 101/350 |
| 5,022,321 | 6/1991 | Witczak | 101/148 |

*Primary Examiner*—Ren Yan

*Attorney, Agent, or Firm*—Jack A. Kanz

[57] ABSTRACT

Foreign particles are removed from the plate cylinder of an offset press by interconnecting two ink form rollers friction driven by the plate roller and/or a vibrating roller to rotate in unison at different surface velocities. The connection between the form rollers maintains a fixed ratio between the surface velocities of the rollers which is other than 1:1 and causes the surface of at least one of the form rollers to wipe the surface of the plate.

24 Claims, 5 Drawing Sheets

HICKEY REMOVAL SYSTEM

This is a continuation of application Ser. No. 08/044,215 entitled Hickey Removal System filed Apr. 7, 1993, now abandoned.

This invention relates to removal of foreign particles from the plate cylinder of a lithographic printing press. More particularly, it relates to methods and apparatus for controlling the relative surface velocity of the plate cylinder and surfaces of ink form rollers in contact with the plate cylinder to provide a wiping and/or scrubbing effect which removes foreign matter from the plate cylinder.

Foreign matter such as lint, paper particles and the like tend to collect on the plate cylinders of offset presses and form blemishes (known in the industry as "hickeys") in the printed material. This problem was addressed in U.S. Pat. No. 3,467,008 to Domotor which discloses a mechanism for directly driving an ink form roller in surface contact with the surface of the plate cylinder at a surface velocity which is less than the surface velocity of the plate cylinder, thereby causing the surfaces to slip with respect to each other and wipe the plate with the form roller to remove foreign matter from the plate. Similar arrangements are disclosed in U.S. Pat. No. 4,724,764 to MacPhee, et al.; United Kingdom Patent No. 1,220,385; United Kingdom Patent Application No. 2,007,156 A; United Kingdom Patent Application No. 2,076,339 A; France Patent No. 2,213,851; Germany Patent No. 1,761,245; and Germany Patent Application No. P 29 32 103.9.27, all of which disclose slipping a form roller with respect to the plate cylinder by directly or indirectly driving the form roller with a dedicated power source.

Although the prior art systems effectively remove the source of many hickeys, they require costly and complicated control systems for positively and individually driving the ink form roller to maintain the required difference between the surface velocities of the ink form roller and the plate. Introduction of additional drive mechanisms, motors, etc., not only increases the cost of the press but places limitations on press operations and introduces additional operating complexities. Thus, the search has continued for effective and inexpensive means for removing hickeys without imposing restrictions on normal press operations.

SUMMARY OF THE INVENTION

In accordance with the present invention the surface velocity of at least one ink form roller is varied with respect to the surface velocity of the plate with which it is in contact to insure that a wiping effect is present at all times between the plate and at least one ink form roller. Control of the ink form roller surface velocity with respect to the plate is accomplished by rotationally interconnecting the shafts supporting two ink form rollers in a manner to assure that the surface velocities of the two rollers are different while maintaining both rollers in contact with the surface of the plate. The ink form rollers are rotated by frictional contact with the plate. However, since the surface velocities of the ink form rollers are not equal, the surface of at least one roller must move faster or slower than the plate and thus wipe the plate to remove hickeys. By interconnecting two ink form rollers, no separate drive system is required. Instead, the ink form rollers remain friction driven by the plate (and/or the vibrating rollers) and drive or retard each other. Furthermore, existing presses can be modified quickly and inexpensively to provide hickey control in accordance with the invention without adversely affecting the performance or operation of the press. Since no additional drive system is required, the modification is relatively inexpensive and does not complicate operation or maintenance of the press. Other features and advantages of the invention will become more readily understood from the following detailed description taken in connection with the appended claims and attached drawing in which:

DESCRIPTION OF THE PREFERRED EMBODIMENTS

Figure 1:
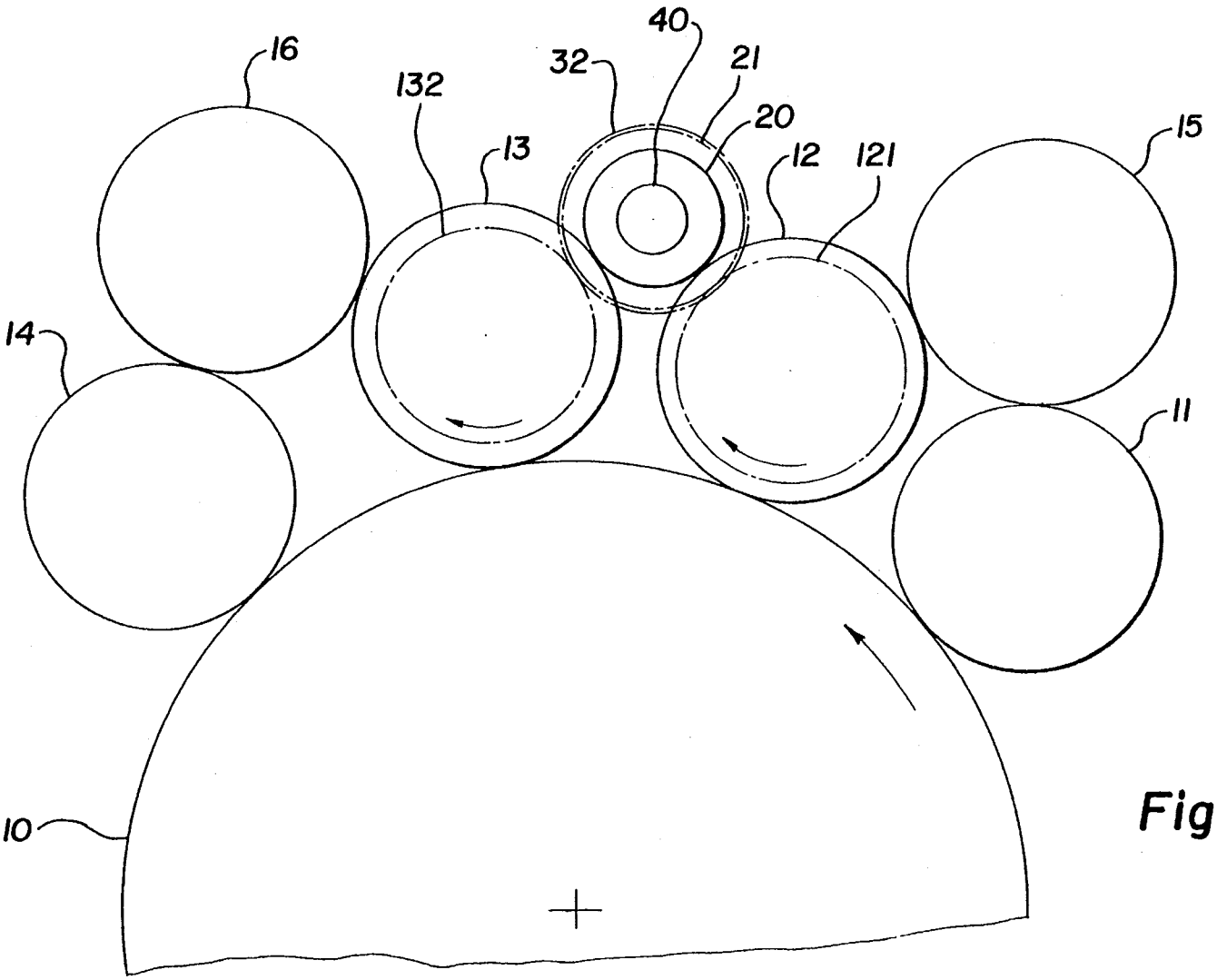
FIG. 1 is a schematic illustration of the roller and cylinder configuration of a lithographic press incorporating a presently preferred embodiment of the hickey removal system of the invention.

The dampening and inking systems of lithographic presses may vary considerably. However, the systems for applying ink to the plate cylinder are fairly well understood and thus conventional. A typical conventional arrangement is illustrated in FIG. 1 wherein four ink form rollers 11, 12, 13, 14 (hereinafter "form rollers") are arranged axially parallel and in peripheral surface contact with the plate cylinder 10. A first vibrating roller 15 is arranged to bridge form rollers 11 and 12 and a second vibrating roller 16 arranged to bridge form rollers 13 and 14. Each of rollers 11, 12, 13 and 14 are in surface contact with the plate cylinder 10 and are thus friction driven by the plate cylinder. Since the vibrating rollers 15, 16 are also directly and positively driven by the press, the form rollers are also friction driven by the vibrating rollers. Thus, in conventional presses, the surface velocities of all rollers and cylinders are substantially the same.

In conventional lithographic presses, the plate cylinder and various rollers such as the vibrating rollers, the blanket cylinder, the impression cylinder, etc., are axially driven by the press drive mechanism. These rollers are referred to herein as axially driven or primary driven rollers. Other rollers, such as the ink form rollers, etc., are axially mounted for free rotation and driven only by surface contact with a primary driven roller or another free roller friction driven by a primary driven roller. These rollers are referred to herein as friction driven rollers.

According to the invention, two friction driven form rollers are rotationally interconnected to rotate in unison but with different surface velocities. In the embodiments illustrated, the shafts supporting the second form roller 12 and third form roller 13 of the press illustrated in FIG. 1 are interconnected. Any pair of rollers could be interconnected. However, the first form roller 11 is sometimes part of the dampening system and is therefore preferably run at the same speed as the plate cylinder. For other reasons it is preferred that the final form roller 14 also run at plate cylinder speed.

In the preferred embodiment of the invention, form rollers 12 and 13 are directly interconnected by gears so that the surface velocity of one roller is always different from the surface velocity of the other (except when stopped). The interconnection maintains a fixed ratio between the surface velocity of roller 12 and the surface velocity of roller 13 which is other than 1:1. Various simple devices can be used for accomplishing this effect. For example, a pulley or sprocket can be attached to the shaft of one roller and connected to a pulley or sprocket attached to the shaft of the other roller by an interconnecting drive belt, chain or the like. If the diameters of the pulleys or sprockets are different, the rollers will rotate at different surface velocities. However, since axial alignment of the rollers and uniform contact of the rollers with the plate cylinder is necessary for proper operation of the press, form rollers 12 and 13 are preferably interconnected with drivingly engaged gears.

Figure 2:
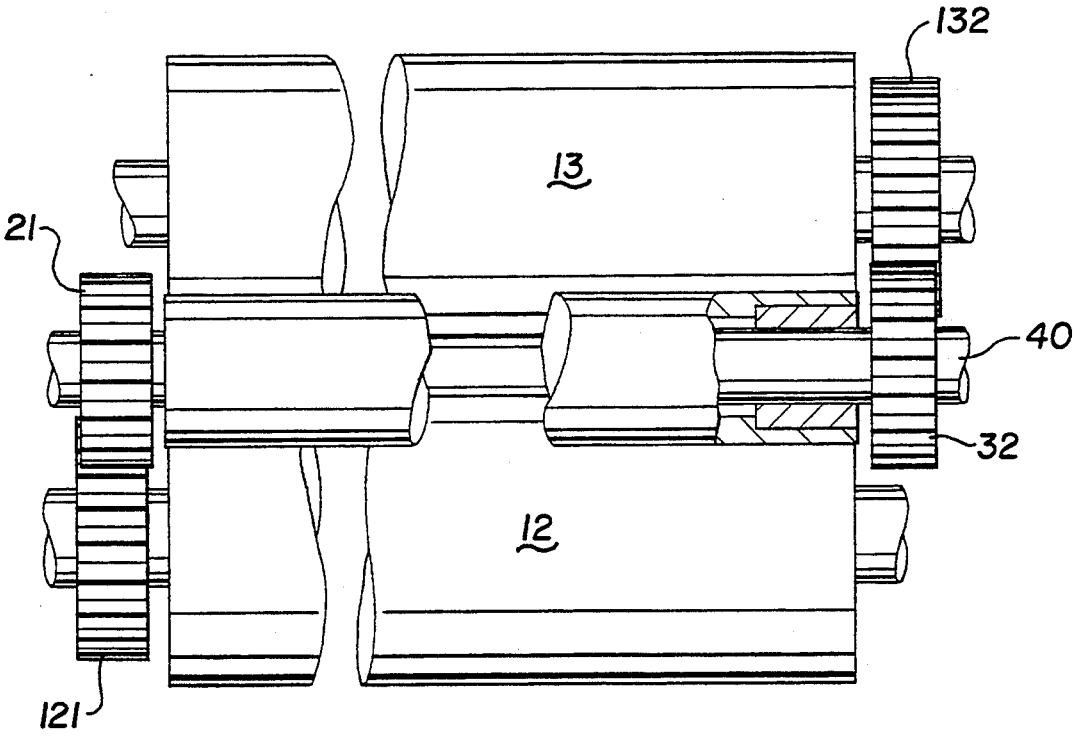
FIG. 2 is a top view of the hickey removal system of FIG. 1.

In the embodiment illustrated in FIGS. 1 and 2, gears of different diameters are attached to the ends of the form rollers and interconnected by a bridge or idler gear arrangement. As more clearly illustrated in FIG. 2, a bridge shaft 40 is positioned above, between and parallel with form rollers 12 and 13 (the second and third rollers in a series of four form rollers). A first bridge drive gear 21 is secured to one end of shaft 40 and a second bridge drive gear 32 secured on the opposite end. A first form roller gear 121 is secured to the shaft of form roller 12 and a second form roller gear 132 attached to the shaft of roller 13. Gears 32 and 132 are aligned in engaging relationship and gears 21 and 121 are aligned in engaging relationship on opposite sides of the press. If gears 21 and 32 are the same size and gears 121 and 132 are the same size, the form rollers 12 and 13 will rotate in unison at the identical surface velocity when the diameters of form rollers 12 and 13 are identical. However, in accordance with the invention, first form roller gear 121 has a larger diameter than second form roller gear 132. Accordingly, if rollers 12 and 13 have the same diameter, the rollers will rotate in unison but the surface velocities of the rollers 12 and 13 will be different.

In the embodiment illustrated in FIG. 2, the diameter of second form roller gear 132 is 2.7 inches; the diameter of second bridge drive gear 32 is 2.1 inches; the diameter of first bridge drive gear 21 is 2.0 inches; and the diameter of first form roller gear 121 is 2.7 inches. The diameter of form roller 12 is $3\frac{1}{8}$ inches and diameter of form roller 13 is $3\frac{1}{4}$ inches. Under these conditions, a ratio of surface velocities is established between rollers 12 and 13 wherein the surface velocities of roller 12 is approximately 90% of the surface velocity of roller 13. Since rollers 12 and 13 are both in contact with the plate cylinder and friction driven by the plate cylinder 10, a surface velocity differential will be maintained between the surface of the plate cylinder 10 and at least one of the rollers 12 and 13 regardless of the speed of the plate cylinder 10. For example, since rotation is imparted to form rollers 12 and 13 by frictional contact with the plate cylinder 10 (and/or the surfaces of vibrating rollers 15, 16 which move at the same surface velocity as the plate), the surface velocity of both form rollers 12 and 13 can never match the surface velocity of the plate 10 at the same time. If the surface velocity of roller 12 is identical to the surface velocity of plate cylinder 10, the surface velocity of roller 13 will be approximately 10% faster than that of the plate 10. Thus a wiping action will occur between the surface of plate cylinder 10 and the surface of form roller 13. On the other hand, if the surface velocity of roller 13 is identical to the surface velocity of plate cylinder 10, the surface velocity of form roller 12 will be approximately 10% slower than the surface velocity of plate cylinder 10, thus forming a wiping action between these two surfaces. Since form rollers 12 and 13 are positively interconnected, a positive speed ratio exists therebetween. However, either or both surfaces may be moving at a surface velocity different from that of plate cylinder 10. In any case, there must be a wiping effect between the surfaces of at least one of the form rollers 12, 13 and plate cylinder 10.

For removal of hickeys from the surface of the plate, the surface of at least one of the form rollers should travel at a surface velocity which is slightly slower or faster than the surface velocity of the plate. This wiping effect tends to dislodge particles from the plate and return them to the ink or dampening system where they may be filtered or otherwise withdrawn from the fluid system. A surface velocity differential between the surface velocity of the plate and the surface velocity of the form roller of at least about 5% has been found effective.

Since form rollers 12 and 13 are secondary driven but positively interconnected to maintain a fixed ratio of their surface velocities which is other than 1:1, the surface of at least one form roller must be moving at a velocity which is different from that of the plate 10. However, since secondary rollers 12 and 13 are in frictional contact with both the plate 10 and the primary driven vibrating rollers 15 and 16, neither roller 12 nor roller 13 will at all times rotate with the same surface velocity of the plate. Instead, depending on various conditions, the surface velocities of the form rollers will vary between a condition wherein one roller moves with the same surface velocity as the plate (with the other moving either faster or slower) and a condition wherein the other roller moves with the same surface velocity as the plate. Between these two conditions one roller moves faster than the plate while the other moves slower than the plate, resulting in a forward and backward scrubbing action on the surface of the plate 10.

In the embodiment illustrated in FIG. 2, shaft 40 is suspended above and between form rollers 12 and 13 and drive gears 21 and 32 are affixed to opposite ends thereof. It will be recognized that the interconnecting gears 132, 32 and 121 could all be arranged on the same side of the press and an identical set of gears arranged on the opposite side. Any of these gear arrangements may be used to satisfy the particular space requirements of the press involved and/or to insure proper axial alignment of the form rollers with respect to each other and the plate cylinder 10.

Figure 3:
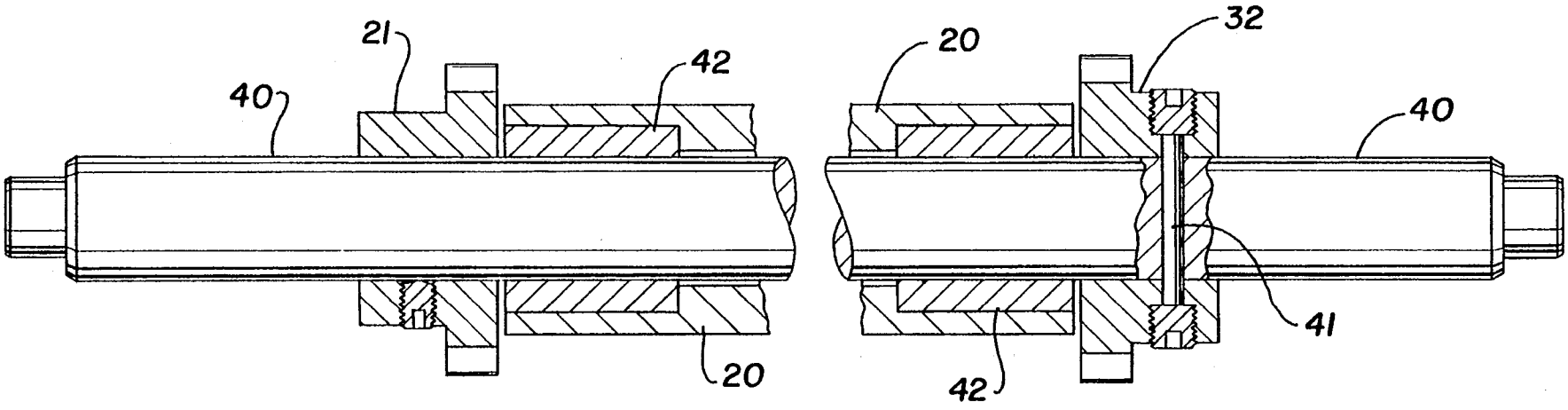
FIG. 3 is a sectional view of the bridge roller employed in the preferred embodiment of the invention.

It will be recognized that since rollers 12 and 13 must rotate at different surface velocities and since both are always in contact with the plate cylinder, damage may occur to either the plate cylinder or the form rollers if the press is run dry. Accordingly, to prevent damage in such cases, one of the interconnection gears should be connected to its respective shaft with a shear pin or the like to permit disengagement of the interconnection system. As illustrated in FIG. 3, second bridge drive gear 32 is connected to shaft 40 by a shear pin 41 passing through the hub of gear 32 and through shaft 40. Accordingly, if sufficient stress is placed on the shaft 40 with respect to gear 32, shear pin 41 will be sheared to permit rotation between the gear 32 and shaft 40, thus permitting rollers 12 and 13 to rotate in contact with the surface of the plate 10 at the same surface velocity.

As illustrated in FIG. 3, a bridge roller 20 may be mounted on shaft 40 by bronze bushings 42 or the like to rotate independently of shaft 40 but in contact with the surfaces of both rollers 13 and 14. It will be observed that since the surface velocities of rollers 13 and 14 are different, a wiping action will also occur between the surfaces of bridge roller 20 and at least one of the surfaces of rollers 12 and 13. Roller 20 is supported on shaft 40 and serves to further control the spread of ink on form rollers 12 and 13.

In the embodiment illustrated, roller 20 merely rests on the surfaces of form rollers 12, 13 and thus supports bridge drive gears 21, 32 at the appropriate location with respect to gears 121 and 132. Shaft 40 may, of course, be journaled in suitable bearings (not shown) mounted on the press frame for supporting the shaft 40 at the proper location. Furthermore, roller 20 may be omitted. Various other arrangements will be apparent to those skilled in the art.

Figure 4:
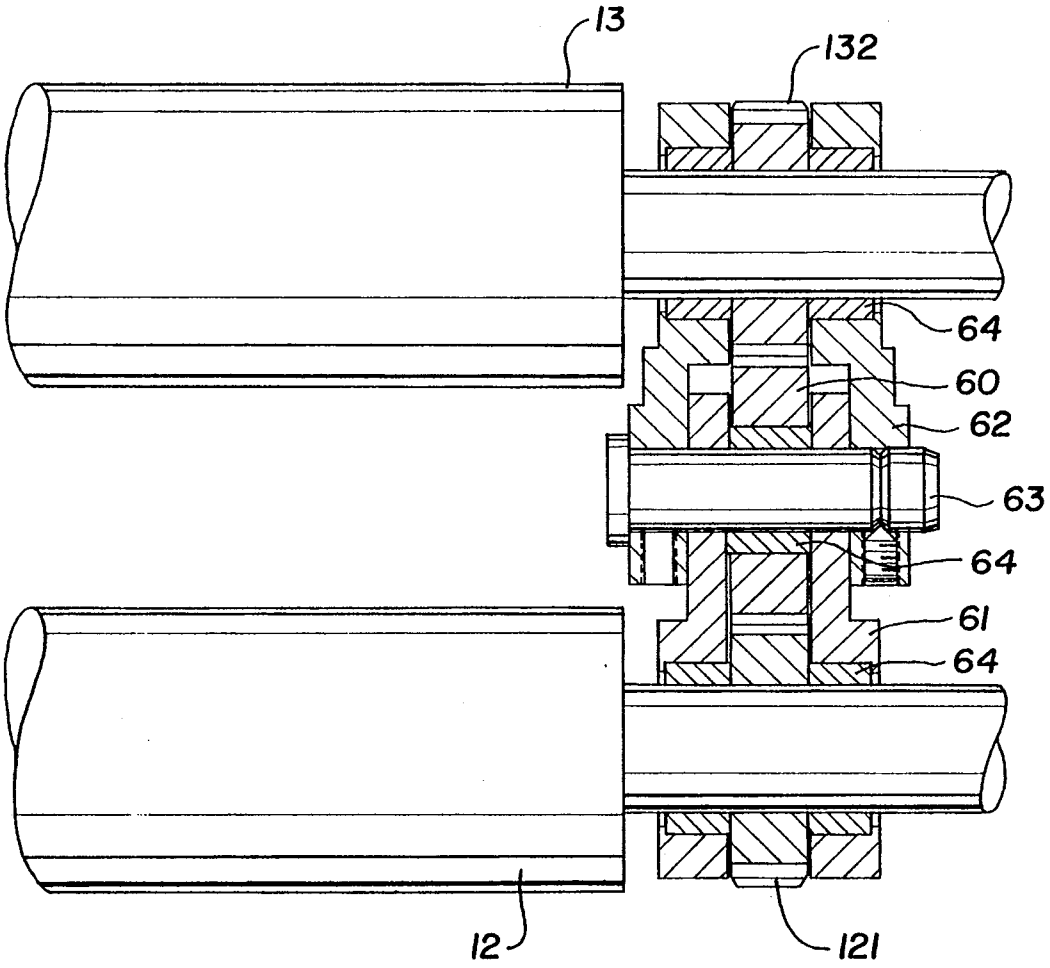
FIG. 4 is a top view, partially in section, of an alternative embodiment of the invention.
Figure 5:
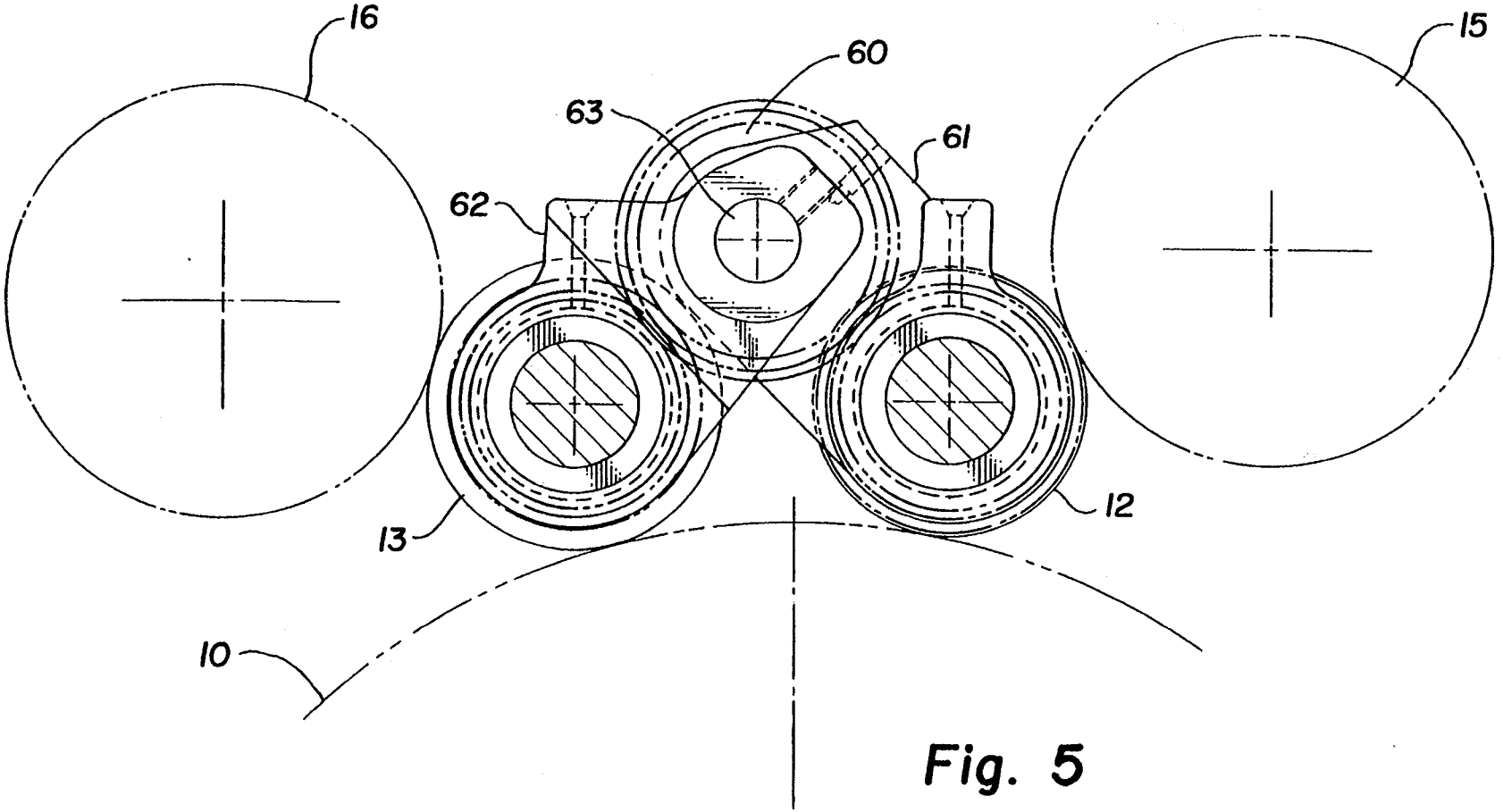
FIG. 5 is a schematic illustration of the cylinder and roller configuration of the embodiment of FIG. 4.

An alternative gear arrangement is illustrated in FIGS. 4 and 5 wherein bridge shaft 40 is omitted and the form rollers 12 and 13 are interconnected on one end by an idler or bridge gear 60 drivingly engaging first form roller gear 121 and second form roller gear 132. In this arrangement first form roller gear 121 is secured to the shaft of form roller 12 on the same side of the press as and aligned with second form roller gear 132 secured to the shaft of form roller 13. A first bracket 61 is connected to a second bracket 62 in pivoting arrangement by pivot pin 63. First bracket 61 is also journaled about the shaft of form roller 12 with bushings or bearings 64 and second bracket 62 is journaled about the shaft of roller 13 in similar manner. Idler gear 60 is supported for free rotation about pivot pin 63 with bushings or bearings 64 and sized to drivingly engage both form roller gear 121 and form roller gear 132. In order to assure that the surface velocities of rollers 12 and 13 are not the same, the diameters of gears 121 and 132 must be different and/or the diameters of rollers 12 and 13 must be different.

It will be noted that in the arrangement of FIGS. 4 and 5 the interconnection between rollers 12 and 13 is only on one end of the rollers and occupies very little space. Nevertheless, the rollers 12 and 13 remain friction driven but interconnected with surface velocities of a fixed ratio which is other than 1:1. However, since the entire coupling mechanism is supported on the roller shafts by pivoting brackets 61 and 62, the spacing between the axes of the form rollers 12 and 13 can be readily adjusted as required. The interconnecting brackets adjust automatically and do not interfere with such normal press adjustments. It will be recognized, of course, that an identical interconnection may be positioned on the opposite ends of rollers 12 and 13 or, if desired, a third roller connected to one of rollers 12, 14 at the opposite side of the press by a similar connecting arrangement.

Form rollers interconnected in accordance with the invention remain secondary driven rollers insofar as they remain friction driven by one or more primary driven rollers. Thus no additional primary drive system is required. Nevertheless, since the form rollers are interconnected in such a manner as to assure that the ratio of their surface velocities is always other than 1:1, at least one form roller acts as a wiper to dislodge hickeys from the plate. Since the interconnected form rollers are friction driven, any variation in surface friction between the form rollers and their driving rollers will cause the form rollers 12, 13 to slip in opposite directions with respect to the plate and thus scrub hickeys from the plate.

It will be appreciated that the principles of the invention may be readily applied to existing presses with rather inexpensive modifications. Furthermore, the modifications have negligible effect on maintenance or power requirements of the press.

While the invention has been described with particular reference to specific embodiments thereof, the forms shown and describe in detail are to be taken as preferred embodiments thereof. Various changes, modifications and re-arrangements may be resorted to without departing from the spirit and scope of the invention as defined by the appended claims.

What is claimed:

1. In a lithographic press, the combination comprising:

(a) a plate cylinder having a plate surface moving at a first surface velocity;

(b) a first ink form roller having a surface in contact with said plate surface and mounted on a first shaft rotationally driven only by the combination of surface contact between said first ink form roller and other rotating cylinders in said press and direct interconnection with the shaft of a second ink form roller;

(c) a second ink form roller having a surface in contact with said plate surface and mounted on a second shaft rotationally driven only by the combination of surface contact between said second ink form roller and other rotating cylinders in said press and direct interconnection with said first shaft of said first ink form roller; and (d) a rotational interconnection between said first shaft and said second shaft which maintains the surface velocity of said first ink form roller different from the surface velocity of said second ink form roller.

2. The combination set forth in claim 1 wherein said interconnection maintains a fixed ratio between the surface velocity of said first ink form roller and the surface velocity of said second ink form roller.

3. The combination set forth in claim 1 wherein said interconnection maintains the surface velocity of said first ink form roller approximately 10% less than the surface velocity of said second ink form roller.

4. The combination set forth in claim 1 wherein said interconnection comprises:

(a) a shaft mounted parallel with said first ink from roller and said second ink form roller;

(b) a first drive gear mounted adjacent one end of said shaft and a second drive gear mounted adjacent the other end of said shaft;

(c) a gear mounted on said first ink form roller in driving engagement with said first drive gear; and (d) a gear mounted on said second ink form roller in driving engagement with said second drive gear.

5. The combination set forth in claim 4 wherein said shaft is journaled on bearings secured to the frame of the lithographic press.

6. The combination set forth in claim 4 including a cylinder supported for rotation about said shaft.

7. The combination set forth in claim 6 wherein said cylinder is in peripheral contact with and supported by said first ink form roller and said second ink form roller.

8. The combination set forth in claim 1 wherein said interconnection comprises:

(i) a first gear mounted on said first shaft;

(ii) a second gear mounted on said second shaft; and (iii) a direct mechanical connection between said first gear and said second gear.

9. The combination set forth in claim 8 wherein said direct mechanical connection comprises an idler gear in driving engagement with said first gear and said second gear.

10. The combination set forth in claim 8 wherein the diameter of said first gear is different from the diameter of said second gear.

11. In a lithographic press, the combination comprising:

(a) a plate cylinder having a plate surface moving at a first surface velocity;

(b) a first ink form roller mounted on a first shaft and having a surface in contact with said plate surface;

(c) a second ink form roller mounted on a second shaft and having a surface in contact with said plate surface; and (d) a rotational interconnection between said first shaft and said second shaft which maintains the surface velocity of said first ink form roller different from the surface velocity of said second ink form roller comprising:

(i) a shaft mounted parallel with said first ink form roller and said second ink form roller;

(ii) a first drive gear mounted adjacent one end of said shaft and a second drive gear mounted adjacent the other end of said shaft;

(iii) a gear mounted on said first ink form roller in driving engagement with said first drive gear; and (iv) a gear mounted on said second ink form roller in driving engagement with said second drive gear.

12. The combination set forth in claim 11 wherein said shaft mounted parallel with said first and second ink form rollers is journaled in bearings secured to the frame of the lithographic press.

13. The combination set forth in claim 11 including a cylinder supported for rotation about said shaft.

14. The combination set forth in claim 13 wherein said cylinder is in peripheral contact with and supported by said first ink firm roller and said second ink form roller.

15. In a lithographic press, the combination comprising:

(a) a plate cylinder having a plate surface moving at a first surface velocity;

(b) a first ink form roller mounted on a first shaft and having a surface in contact with said plate surface;

(c) a second ink form roller mounted on a second shaft and having a surface in contact with said plate surface; and (d) a rotational interconnection between said first shaft and said second shaft which maintains the surface velocity of said first ink form roller different from the surface velocity of said second ink form roller comprising:

(i) a first gear secured to said first shaft;

(ii) a second gear secured to said second shaft; and (iii) bridge means in driving engagement with said first gear and said second gear powered for rotational movement only by its interconnection with said first gear and said second gear.

16. The combination set forth in claim 15 wherein said bridge means is an idler gear in direct driving engagement with said first gear and said second gear.

17. The combination set forth in claim 15 wherein said bridge means includes:

(a) a bridge shaft mounted parallel with said first ink form roller and said second ink form roller;

(b) a first drive gear mounted adjacent one end of said bridge shaft in driving engagement with said first gear secured to said first shaft; and (c) a second drive gear mounted adjacent the other end of said bridge shaft in driving engagement with said second gear secured to said second shaft.

18. The combination set forth in claim 17 including a bridge roller mounted on said bridge shaft having a surface in contact with the surface of said first ink form roller and the surface of said second ink form roller.

19. In a lithographic press, the combination comprising:

(a) a plate cylinder having a plate surface moving at a first surface velocity;

(b) a first form roller mounted on a first shaft and having a surface in contact with said plate surface;

(c) a second form roller mounted on a second shaft and having a surface in contact with said plate surface; and (d) connection means between said first shaft and said second shaft driven only by said first shaft and said second shaft which maintains the surface velocity of said first form roller different from the surface velocity of said second form roller;

wherein said first form roller and said second form roller are rotated only by surface contact with other rotating cylinders in said lithographic press.

20. The combination set forth in claim 19 wherein said connection means comprises:

(i) a first gear secured to said first shaft;

(ii) a second gear secured to said second shaft;

(iii) a bridge shaft mounted parallel with said first form roller and said second form roller;

(iv) a first drive gear mounted adjacent one end of said bridge shaft in driving engagement with said first gear; and (v) a second drive gear mounted adjacent the other end of said bridge shaft in driving engagement with said second gear.

21. The combination set forth in claim 20 including a bridge roller mounted on said bridge shaft in contact with the surface of said first form roller and said second form roller.

22. The combination set forth in claim 19 wherein said connection means comprises:

(a) a first gear secured to said first shaft;

(b) a second gear secured to said second shaft; and (c) a bridge gear in direct driving engagement with said first gear and said second gear.

23. The combination set forth in claim 22 wherein the diameter of said first gear is different from the diameter of said second gear.

24. The combination set forth in claim 22 including:

(a) first bracket journaled on said first shaft;

(b) a second bracket journaled on said second shaft;

(c) a pivot pin connecting said first bracket and said second bracket in pivoting arrangement; and (d) a gear supported on said pivot pin and in driving engagement with said first gear and said second gear.

* * * * *

UNITED STATES PATENT AND TRADEMARK OFFICE

CERTIFICATE OF CORRECTION

PATENT NO. : 5,345,865

DATED : September 13, 1994

INVENTOR(S) : Norman H. Kemp

It is certified that error appears in the above-identified patent and that said Letters Patent is hereby corrected as shown below:

Column 3, line 51, "velocities" should read ---velocity---

Column 6, line 52, "from" should read ---form---

Column 7, line 47 "firm" should read ---form---

Signed and Sealed this

Fifteenth Day of November, 1994

*Attest:*

*Attesting Officer*

BRUCE LEHMAN

*Commissioner of Patents and Trademarks*